US011404819B2

(12) United States Patent
Reinhardt et al.

(10) Patent No.: US 11,404,819 B2
(45) Date of Patent: Aug. 2, 2022

(54) CONTACT DEVICE, CONTACT SYSTEM HAVING SUCH A CONTACT DEVICE AND METHOD FOR PRODUCING SUCH A CONTACT SYSTEM

(71) Applicant: TE Connectivity Germany GmbH, Bensheim (DE)

(72) Inventors: Marc Reinhardt, Bensheim (DE); Aron Loecser, Riedstadt (DE); Anne Weiss, Alsbach-Haehnlein (DE)

(73) Assignee: TE Connectivity Germany GmbH, Bensheim (DE)

( * ) Notice: Subject to any disclaimer, the term of this patent is extended or adjusted under 35 U.S.C. 154(b) by 0 days.

(21) Appl. No.: 17/028,254

(22) Filed: Sep. 22, 2020

(65) Prior Publication Data

US 2021/0006011 A1 Jan. 7, 2021

Related U.S. Application Data

(63) Continuation of application No. PCT/EP2019/056818, filed on Mar. 19, 2019.

(30) Foreign Application Priority Data

Mar. 22, 2018 (DE) ..... 10 2018 106 868.9

(51) Int. Cl.
*H01R 13/627* (2006.01)
*H01R 24/50* (2011.01)

(52) U.S. Cl.
CPC ..... *H01R 13/6272* (2013.01); *H01R 24/50* (2013.01)

(58) Field of Classification Search
CPC .... H01R 13/6272; H01R 24/50; H01R 24/38; H01R 13/6581; H01R 43/20; H01R 13/504; H01R 13/6599
See application file for complete search history.

(56) References Cited

U.S. PATENT DOCUMENTS 4,388,544 A * 6/1983 Gillet ..... H02K 13/02 310/71
7,326,063 B1 * 2/2008 Raudenbush ..... H01R 12/7052 439/63

(Continued)

FOREIGN PATENT DOCUMENTS

CA 2675514 A1 8/2008
CA 2675559 A1 8/2008

(Continued)

OTHER PUBLICATIONS

PCT Notification, International Search Report and Written Opinion of the International Searching Authority, dated Jun. 6, 2019, 18 pages.

(Continued)

*Primary Examiner* — Abdullah A Riyami
*Assistant Examiner* — Nelson R. Burgos-Guntin
(74) *Attorney, Agent, or Firm* — Barley Snyder

(57) ABSTRACT

A contact device includes a first coaxial contact unit and a first contact housing connected to the first coaxial contact unit. The first coaxial contact unit has a first inner contact and a first outer contact, the first outer contact is arranged spaced apart from and coaxial with the first inner contact. The first coaxial contact unit electrically connects to a second coaxial contact unit of a further contact device. The first contact housing has a first encoding unit with a first riveting device having a first head section and a first shaft section connected to the first head section. The first shaft section engages a first receptacle of a second contact housing of the further contact device and positions the first contact housing relative to the second contact housing. The first head section protrudes laterally over the first shaft section.

20 Claims, 11 Drawing Sheets

(56) References Cited

U.S. PATENT DOCUMENTS

| | | | | |
|---|---|---|---|---|
| 9,595,795 | B2 * | 3/2017 | Lane | H01R 24/50 |
| 2002/0061670 | A1 * | 5/2002 | Havener | H01R 24/50<br>439/246 |
| 2004/0053531 | A1 * | 3/2004 | Annequin | H01R 13/639<br>439/578 |
| 2008/0188123 | A1 * | 8/2008 | Hall | H01R 13/6593<br>439/569 |
| 2009/0199801 | A1 * | 8/2009 | Imai | F01L 1/352<br>123/90.17 |
| 2016/0164232 | A1 * | 6/2016 | Lane | H01R 24/50<br>439/578 |
| 2021/0006011 | A1 * | 1/2021 | Reinhardt | H01R 13/6581 |

FOREIGN PATENT DOCUMENTS

| | | | |
|---|---|---|---|
| CN | 201000965 | Y | 1/2008 |
| CN | 101595606 | A | 12/2009 |
| CN | 101601174 | A | 12/2009 |
| CN | 101908696 | A | 12/2010 |
| CN | 107394543 | A | 11/2017 |
| GB | 2237459 | A | 5/1991 |
| WO | 2008094650 | A2 | 8/2008 |

OTHER PUBLICATIONS

First Office Action from the CNIPA in Appln. No 201980020844.3, dated May 17, 2021, and English translation thereof, 16 pp.
Abstract of CN101908696 (A), dated Dec. 8, 2010, 1 p.
Abstract of CN107394543 (A), dated Nov. 24, 2017, 1 p.
Abstract of CN201000965 (Y), dated Jan. 2, 2008, 1p.

* cited by examiner

CONTACT DEVICE, CONTACT SYSTEM HAVING SUCH A CONTACT DEVICE AND METHOD FOR PRODUCING SUCH A CONTACT SYSTEM

CROSS-REFERENCE TO RELATED APPLICATIONS

This application is a continuation of PCT International Application No. PCT/EP2019/056818, filed on Mar. 19, 2019, which claims priority under 35 U.S.C. § 119 to German Patent Application No. 102018106868.9, filed on Mar. 22, 2018.

FIELD OF THE INVENTION

The present invention relates to a contact device and, more particularly, to a contact device of a contact system.

BACKGROUND

Contact devices with encoding ribs are known. Known contact systems having such contact devices, however, have a low retaining force and can be difficult to assemble.

SUMMARY

A contact device includes a first coaxial contact unit and a first contact housing connected to the first coaxial contact unit. The first coaxial contact unit has a first inner contact and a first outer contact, the first outer contact is arranged spaced apart from and coaxial with the first inner contact. The first coaxial contact unit electrically connects to a second coaxial contact unit of a further contact device. The first contact housing has a first encoding unit with a first riveting device having a first head section and a first shaft section connected to the first head section. The first shaft section engages a first receptacle of a second contact housing of the further contact device and positions the first contact housing relative to the second contact housing. The first head section protrudes laterally over the first shaft section.

BRIEF DESCRIPTION OF THE DRAWINGS

The invention will now be described by way of example with reference to the accompanying Figures, of which.

DETAILED DESCRIPTION OF THE EMBODIMENT(S)

In the following, the invention is explained in greater detail with reference to the accompanying drawings, in which exemplary advantageous embodiments are shown. The shown advantageous developments and embodiments are independent from one another and can be combined arbitrarily according to the application.

In FIGS. 1 to 10 and 12 below, reference is made to a coordinate system. The coordinate system is configured as a right-handed system and has an x-axis (longitudinal direction), a y-axis (transverse direction) and a z-axis (vertical direction).

Figure 1:
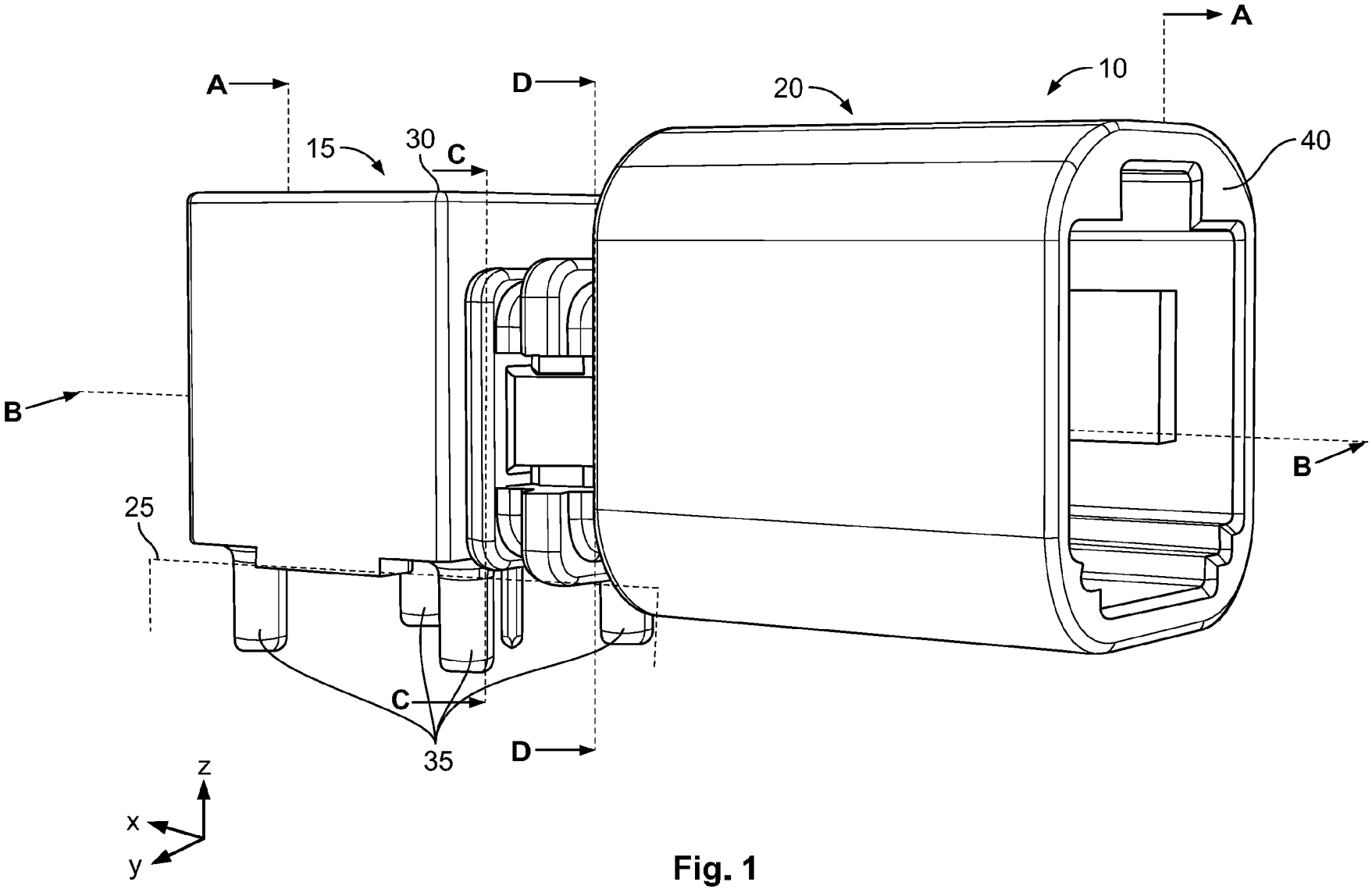
FIG. 1 is a perspective view of a contact system according to an embodiment.

A contact system 10 according to an embodiment, as shown in FIG. 1, includes a first contact device 15 and a second contact device 20. Additionally, the contact system 10 can have a printed circuit board 25 (indicated by a dashed line in FIG. 1). The first contact device 15 has a first contact housing 30. The first contact housing 30 has on its underside at least one pin 35, four pins 35 in the shown embodiment, which are arranged spaced apart from one another in a square. The pins 35 engage in corresponding pin receptacles of the printed circuit board 25, and secure the first contact housing 30 to the printed circuit board 25. The pin 35 can be electrically connected to a first conductor path of the printed circuit board 25. The first contact housing 30 is configured in an electrically conductive manner and has at least one of the following substances: zinc, tin, aluminum, copper, magnesium, brass, iron, steel, bronze, zinc casting, zinc alloy, ZnAlCuMg. In an embodiment, the first contact housing 30 is cast, in particular in a pressure die-casting.

The first contact device 15 and the second contact device 20 are connected to one another, as shown in FIG. 1. The second contact device 20 has a second contact housing 40, said second contact housing 40 being plugged onto the first contact housing 30. The second contact housing 40 can have an electrically conductive or an electrically insulating substance. The substance of the second contact housing 40 can be identical to the substance of the first contact housing 30.

Figure 2:
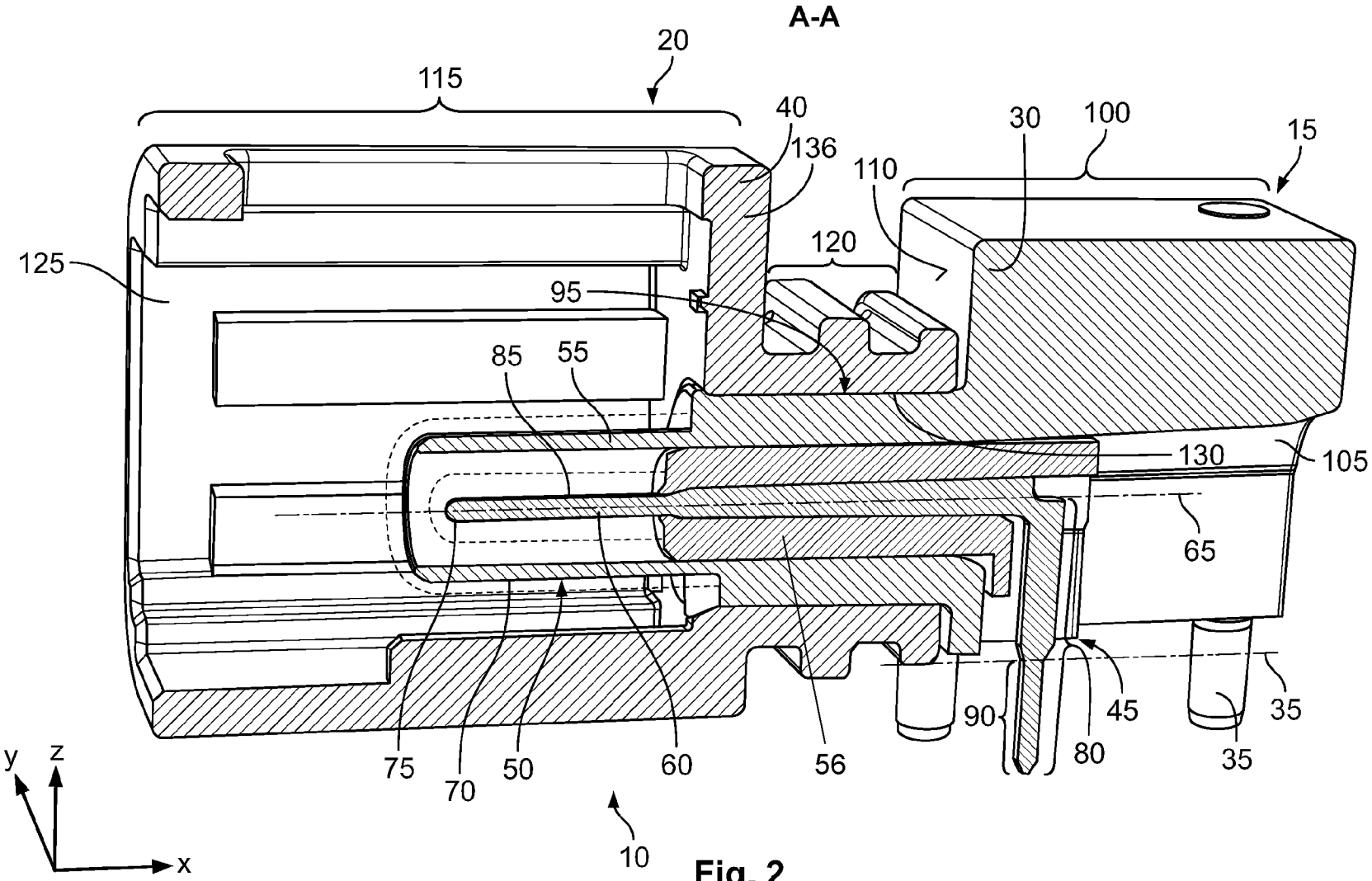
FIG. 2 is a sectional perspective view of the contact system taken along plane A-A of FIG. 1.

FIG. 2 shows a sectional view along a section plane A-A, shown in FIG. 1, through the contact system 10 shown in FIG. 1. The first contact device 15 has, in addition to the first contact housing 30, a first coaxial contact unit 45. The second contact device 20 has a second coaxial contact unit 50 (depicted schematically in dashed lines in FIG. 2). The second coaxial contact unit 50 is configured in a manner corresponding to the first coaxial contact unit 45 and is thus configured as a female coaxial contact unit 50 in the embodiment. It would also be conceivable for the first coaxial contact unit 45 to be configured as a female coaxial contact unit 45, and for the second coaxial contact unit 50 to be configured as a male coaxial contact unit 50.

As shown in FIG. 2, the first coaxial contact unit 45 has a first outer contact 55, an insulating element 56, and a first inner contact 60. The first inner contact 60 and the first outer contact 55 are guided in sections coaxially to a contact axis 65. The contact axis 65 extends parallel to the x-axis. The insulating element 56 is arranged, radially in relation to the contact axis 65, between the first outer contact 55 and the first inner contact 60. The first outer contact 60 is configured cylindrically on the inside in the shown embodiment. The insulating element 56 has a dielectric as the substance. The insulating element 56 electrically insulates the first inner contact 60 from the first outer contact 55.

The second coaxial contact unit 50 has a second outer contact 70 and a second inner contact 75, as shown in FIG. 2. The second inner contact 75 has a first electrical contact with the first inner contact 60 and the second outer contact 70 has a second electrical contact with the first outer contact 55. The second inner contact 75 and the second outer contact 70 are also arranged coaxially in relation to the contact axis 65. In the embodiment, the second inner contact 75 and the second outer contact 70 are each configured as a female contact element. The second inner contact 75 engages circumferentially around the first inner contact 60 and the second outer contact 70 engages around the first outer contact 55.

The first inner contact 60 is configured as an angular plug and, as shown in FIG. 2, has an angled angular section 80 and a first contact section 85. The angular section 80 is arranged inclined, perpendicularly in an embodiment, to the contact axis 65 and to the first contact section 85 and runs in the z-direction. The first contact section 85 is electrically connected to the second inner contact 75. The angular section 80 is aligned parallel to the pin 35. On the underside, the angular section 80 engages, with a second contact section 90, in the printed circuit board 25 and electrically connects the angular section 80 to a second conductor path of the printed circuit board 25.

As shown in FIG. 2, the first contact housing 30 has a first encoding unit 95 and a first housing section 100. The first housing section 100 is configured in a substantially cuboid manner and has a first contact receptacle 105 for receiving the first coaxial contact unit 45. In the embodiment, the first contact receptacle 105 is arranged substantially in a central location in relation to the configuration of the first housing section 100.

The first encoding unit 95 is arranged at a first end face 110 of the first housing section 100, as shown in FIG. 2. The first end face 110 extends in a yz-plane and is configured in a planar manner. The first encoding unit 95 and the first housing section 100 are configured in an integral and materially uniform manner. In this case, the first encoding unit 95 protrudes over the first end face 110 in the direction of the second contact device 20.

As shown in FIG. 2, the second contact housing 40 has a second housing section 115 and a third housing section 120. On the inside of the second housing section 115 there is provided a second contact receptacle 125 for receiving the second coaxial contact unit 50. The second housing section 115 is arranged on a side facing away from the first housing section 100. The third housing section 120 of the second contact housing 40 is arranged between the first housing section 100 and the second housing section 115. In the y-direction and z-direction, the third housing section 120 is configured slimmer than the second housing section 115. The second contact housing 40 has a first receptacle 130. The first receptacle 130 is configured as a through-hole in the third housing section 120 and formed in a side wall 136 of the second section 115. The first receptacle 130 opens onto a side, facing away from the first contact device 15, in the second contact receptacle 125. In this case, the first receptacle 130 is configured slimmer in the z-direction than second contact receptacle 125.

Figure 3:
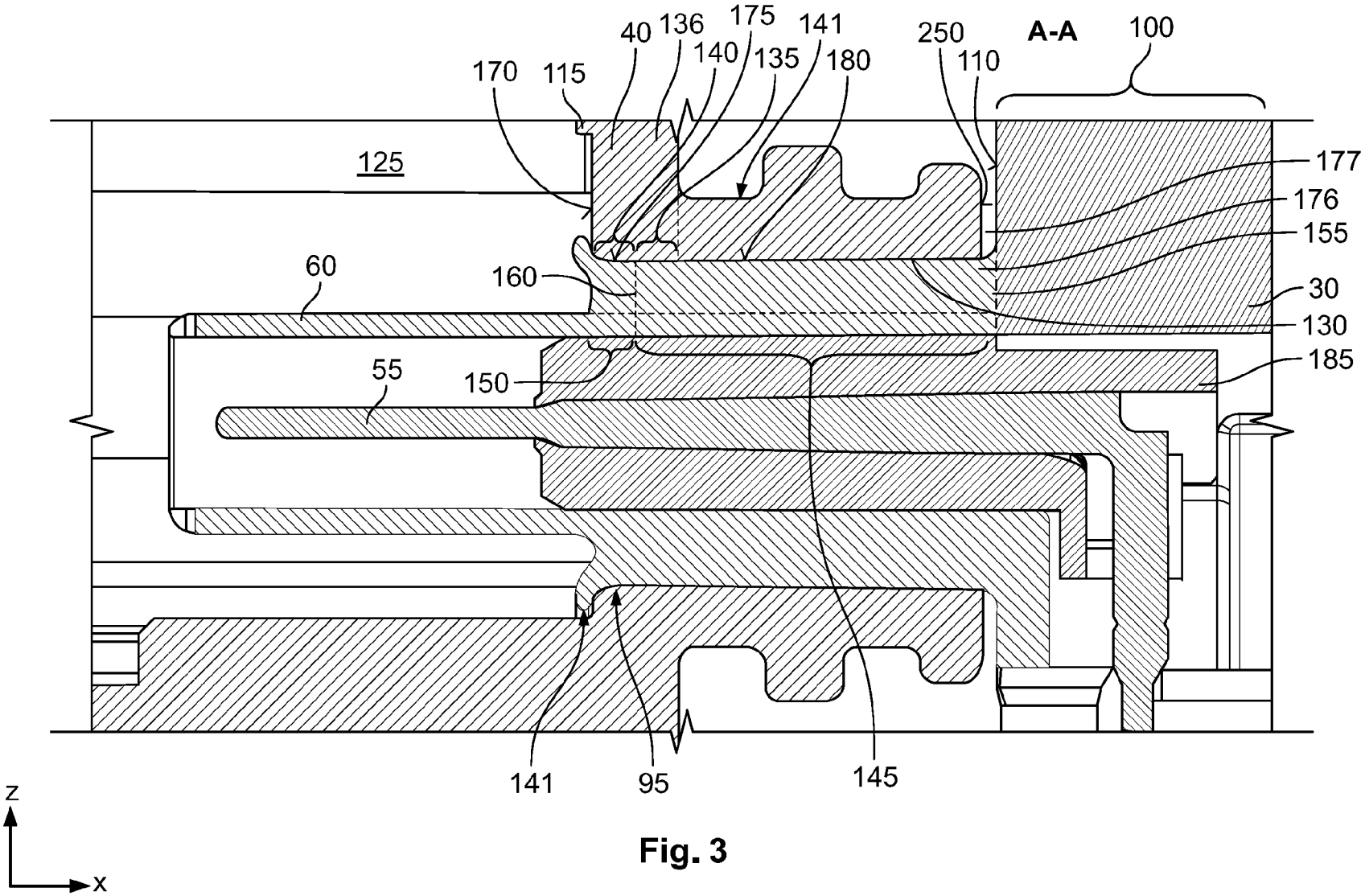
FIG. 3 is a sectional side view of the contact system taken along plane A-A of FIG. 1.

FIG. 3 shows a cutout of the sectional view, shown in FIG. 2, along the section plane A-A, shown in FIG. 1, through the contact system 10. The first receptacle 130 has a first section 135 and a second section 140. The first section 135 and the second section 140 are arranged in the side wall 136, which extends in a yz-plane, of the second housing section 115. The third housing section 120 is connected by one side to the side wall 136. The first section 135 of the first receptacle 130 is configured running parallel to the x-axis and has a constant cross-section. The first section 135 can also be configured conically and tapering from the first end face 110 in the direction of the second housing section 115. The second section 140 adjoins the first section 135 in the x-direction and is arranged on a side of the first receptacle 130 facing away from the first end face 110. The second section 140 widens from the first section 135 in the direction of the second housing section 115. The second section 140 opens into the second contact receptacle 125.

The first encoding unit 95 has a first riveting device 141 with a first shaft section 145 and a first head section 150, as shown in FIG. 3. The first shaft section 145 is connected to the first housing section 100 at a first solid end 155. The first head section 150 is arranged at a first free end 160 of the first shaft section 145. The first shaft section 145 engages in the first section 135. The first shaft section 145 is configured circumferentially corresponding to the first section 135 and positions the first contact housing 30 relative to the second contact housing 40. In the embodiment, the first shaft section 145 is configured like a hollow body. The first outer contact 55 is arranged on the inside of the first shaft section 145. At the end face, the first outer contact 55 protrudes over the first head section 150. The insulating element 56 ends approximately at the level of the first head section 150.

In the embodiment shown in FIG. 3, the first outer contact 55 and the first encoding unit 95, in particular the first shaft section 145, are configured in an integral and materially uniform manner. It would also be conceivable for the first outer contact 55 and the first encoding unit 95, in particular the first shaft section 145, to be configured in several parts. As a result of the electrically conductive substance of the first contact housing 30, reliable shielding of the first inner contact 55 against electromagnetic interference is also ensured in the case of an integral and materially uniform configuration of the first encoding unit 95 with the first outer contact 55. The integral and materially uniform configuration of the first outer contact 55 together with the first encoding unit 95 furthermore has the advantage that an electrical resistance to the attachment of the first outer contact 55 to the first conductor path of the printed circuit board 25 is particularly low.

The first head section 150 engages in the second section 140 as shown in FIG. 3. In this case, the first head section 150 lies with a first circumferential side 175 against the inside of the second section 140. Furthermore, the first head section 150 protrudes in the z-direction and y-direction with the first outer circumferential side 175 over a second outer circumferential side of the second section 140. In addition, the first head section 150 can lie against an inner side 170 of the second contact receptacle 125, on a side facing away from the first end face 110. The first head section 150 thus engages behind the second contact housing 40, in particular the side wall 136, such that the first contact housing 30 is connected in a form-fitting manner to the second contact housing 40. On the rear side, the third housing section 120 can lie against the first end face 110 at the end face or the first shaft section 145 can widen at the solid end 155, such that the first receptacle 130 comes to a stop on a widened portion 176 and a gap 177 is provided between the first end face 110 and a second end face 250 of the third housing section 120. As a result, a particularly secure hold of the first contact housing 30 on the second contact housing 40 is ensured by the first riveting device 141. The form-fitting connection can only be undone by destroying the riveting device 141. As a result, an unintentional pulling-away of the contact housings 30, 40 can be prevented.

Figure 4:
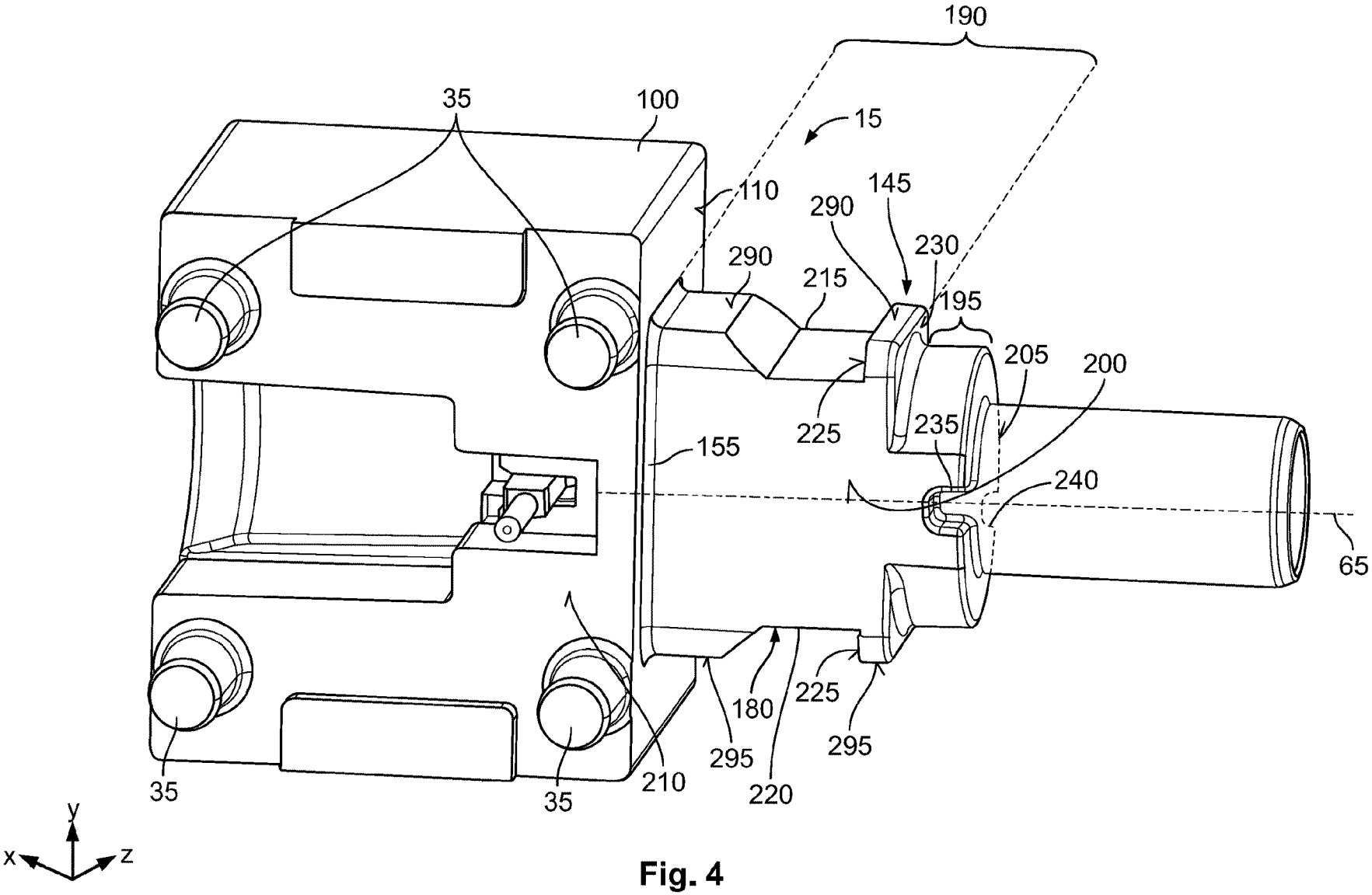
FIG. 4 is a perspective view of a first contact device of the contact system.

A first contact device 15 according to an embodiment is shown in FIG. 4. In FIG. 4, the first contact device 15 is in a premounted state, such that the first head section 150 of the first riveting device 141 is not yet shaped.

The first shaft section 145, as shown in FIG. 4, has a first region 190 and a second region 195. The first region 190 is configured longer than the second region 195 in the x-direction. Furthermore, in the y-direction and in the z-direction, the second region 195 is configured slimmer than the first region 190.

The first region 190 borders the first solid end 155 and adjoins the first end face 110 of the first housing section 100, as shown in FIG. 4. The second region 195 adjoins the first shaft section 145 on a side of the first shaft section 145 facing away from the first end face 110. The first region 190 has a substantially square basic shape (with rounded corner regions for example) in cross-section, whereas on the other hand the second region 195 has a substantially circular basic shape in cross-section.

As shown in FIG. 4, for guiding in the z-direction, the first shaft section 145 has a first guide surface 200 on the second outer circumferential side 180. The first guide surface 200 is configured in a planar manner and extends over both the first region 190 and the second region 195. In this case, at the second region 195, the first guide surface 200 forms a secant-like configuration with respect to the basic shape of the second region 195. In the embodiment, the first guide surface 200 is configured as an xy-plane. The first guide surface 200 is aligned parallel to the contact axis 65.

In the z-direction lying opposite, the first shaft section 145 furthermore has, at the second outer circumferential side 180, a second guide surface 205 (arranged on a side of the first shaft section 145 facing away from the viewer in FIG. 4). The first guide surface 200 and the second guide surface 205 are each configured in a planar manner and are arranged in xy-planes arranged parallel to one another. The first guide surface 200 and the second guide surface 205 are furthermore aligned parallel to an underside 210 of the first housing section 100. The pins 35 are arranged at the underside 210 of the first housing section 100.

In order to ensure an additional guidance of the first shaft section 145 in the y-direction, there can additionally be provided, at the first shaft section 145, a third guide surface 290 and a fourth guide surface 295 arranged opposite the third guide surface 290, as shown in FIG. 4. The third and fourth guide surfaces 290, 295 are arranged at right angles to the first and second guide surfaces 200, 205 and extend substantially in xz-planes spaced apart in the y-direction.

At the circumference, the first region 190 has a first and a second latching receptacle 215, 220 in each case, which laterally border the first and second guide surfaces 200, 205, as shown in FIG. 4. The first and second latching receptacles 215, 220 are arranged opposite one another in the y-direction. The latching receptacles 215, 220 have an exemplary trapezoidal configuration. The first and second latching receptacles 215, 220 taper here from outside to inside. The first and second latching receptacles 215, 220 have a stop surface 225 on a side facing away from the first end face 110, wherein the stop surface 225 is aligned parallel to the first end face 110. The stop surface 225 extends in a yz-plane.

The third guide surface 290 is interrupted by the first latching receptacle 215 in such a way that a subregion of the third guide surface 290 is provided in each case on both sides of the first latching receptacle 215 in the x-direction. Likewise, the fourth guide surface 295 is interrupted by the second latching receptacle 220, wherein the second latching receptacle 220 is arranged in the fourth guide surface 295 in such a way that a subregion of the fourth guide surface 295 is provided in each case on both sides of the fourth guide surface 295 in the x-direction.

As shown in FIG. 4, at a junction between the first region 190 and the second region 195, the first shaft section 145 has a shoulder surface 230 at the end face, wherein the shoulder surface 230 is aligned parallel to the first end face 110. The second region 195 is connected to the first region 190 at the shoulder surface 230. The second region 195 has, by way of example, a first recess 235 and an exemplary second recess 240 arranged opposite the first recess 235 in the z-direction. The first and second recesses 235, 240 are configured identically and are open on a side facing the first end face 110. The first recess 235 borders the first guide surface 200 and the second recess 240 borders the second guide surface 205. In this case, the first recess 235 is arranged centrally with regard to a maximum extent, in the y-direction, of the first guide surface 200. Likewise, the second recess 240 is arranged in a central location in relation to a maximum extent, in the y-direction, of the second guide surface 205. The first recess 235 and the second recess 240 in this case are configured in a groove-like manner. The first and second recesses 235, 240 can also be dispensed with or the first and second recesses 235, 240 can be configured in another way.

Figure 5:
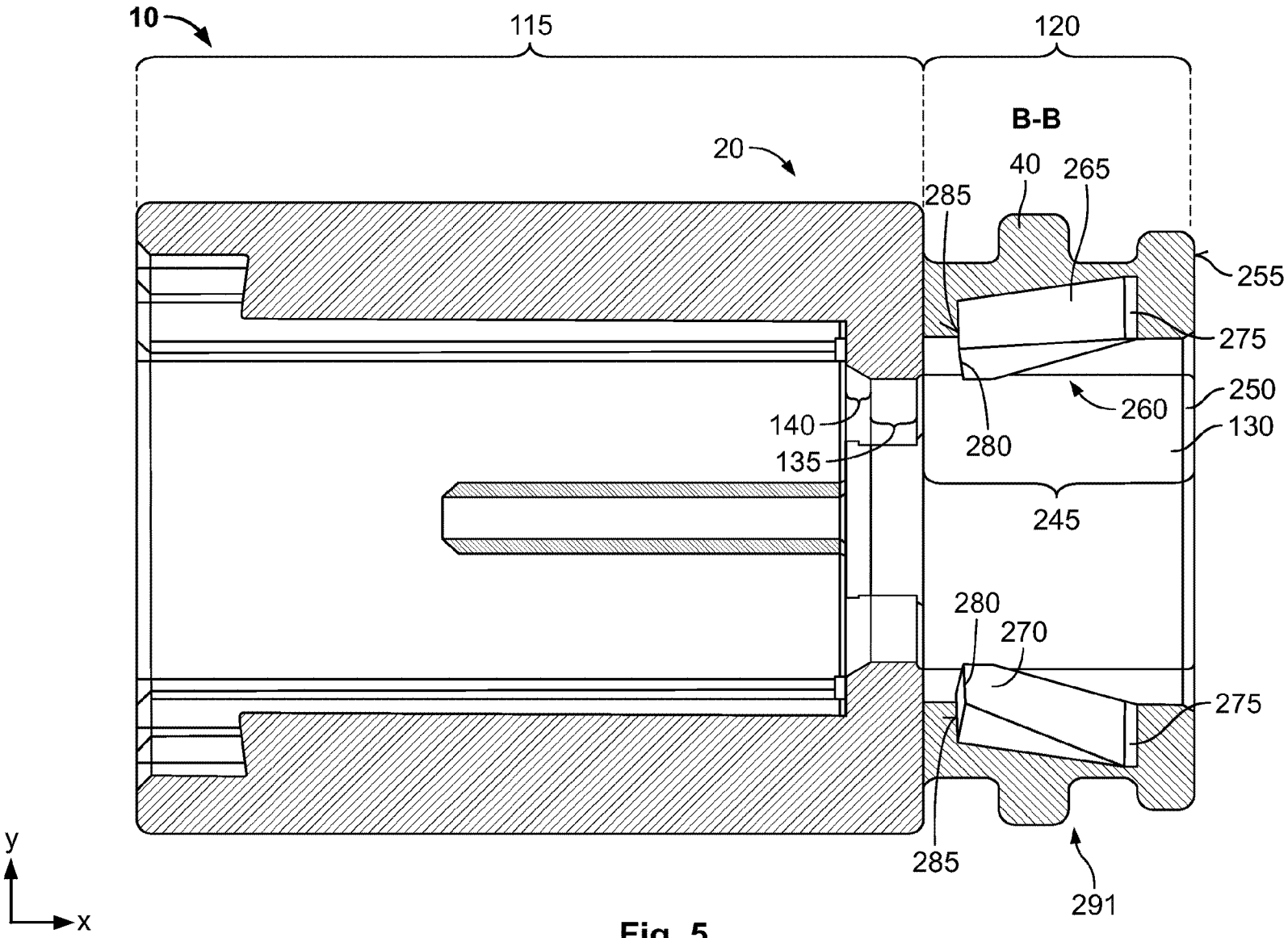
FIG. 5 is a sectional side view of a second contact housing of a second contact device, taken along plane B-B of FIG. 1.

FIG. 5 shows a sectional view along a section plane B-B, shown in FIG. 1, through the second contact housing 40 of the second contact device 20. The first receptacle 130 has, by way of example, a third section 245 in addition to the first section 135 and the second section 140, which are arranged in the second housing section 115. The third section 245 is arranged in the third housing section 120. The third section 245 adjoins the first section 135 on a side of the first section 135 facing the first end face 110. The third section 245 has a larger cross-section than the first section 135. The third section 245 can be configured tapering from an opening 250, on a side facing the first contact housing 30, towards the first section 135. As depicted in FIG. 5, the third section 245 can also have a constant cross-section.

At the opening 250, the first receptacle 130 opens onto the second end face 255, which faces the first end face 110. In the mounted state of the second contact housing 40 on the first contact housing 30, the first end face 110 and the second end face 255 are arranged running parallel spaced apart from one another.

The second contact housing 40 furthermore has a latching device 260, as shown in FIG. 5. In the embodiment, by way of example, the latching device 260 has a first detent spring 265 and optionally at least one second detent spring 270. The first detent spring 265 and the second detent spring 270 are arranged opposite one another in the y-direction on the inside of the third housing section 120. In this case, the detent spring 265, 270 is connected by a second fixed end 275 to the third housing section 120 in each case. In the unmounted state of the second contact housing 40, the detent spring 265, 270 is pivoted inwards in the direction of the first receptacle 130 and is unstressed. In this case, a second free end 280 of the detent spring 265, 270 protrudes into the third section 245. The detent spring 265, 270 has a latching surface 285 at the second free end 280. The latching surface 285 is arranged on a side of the detent spring 265, 270 facing the second housing section 115.

At the circumference, the third housing section 120 is configured slimmer than the second housing section 115, as shown in FIG. 5. The third housing section 120 has a stepped portion 291 on the outside. A retaining tool can engage in the stepped portion 291.

Figure 6:
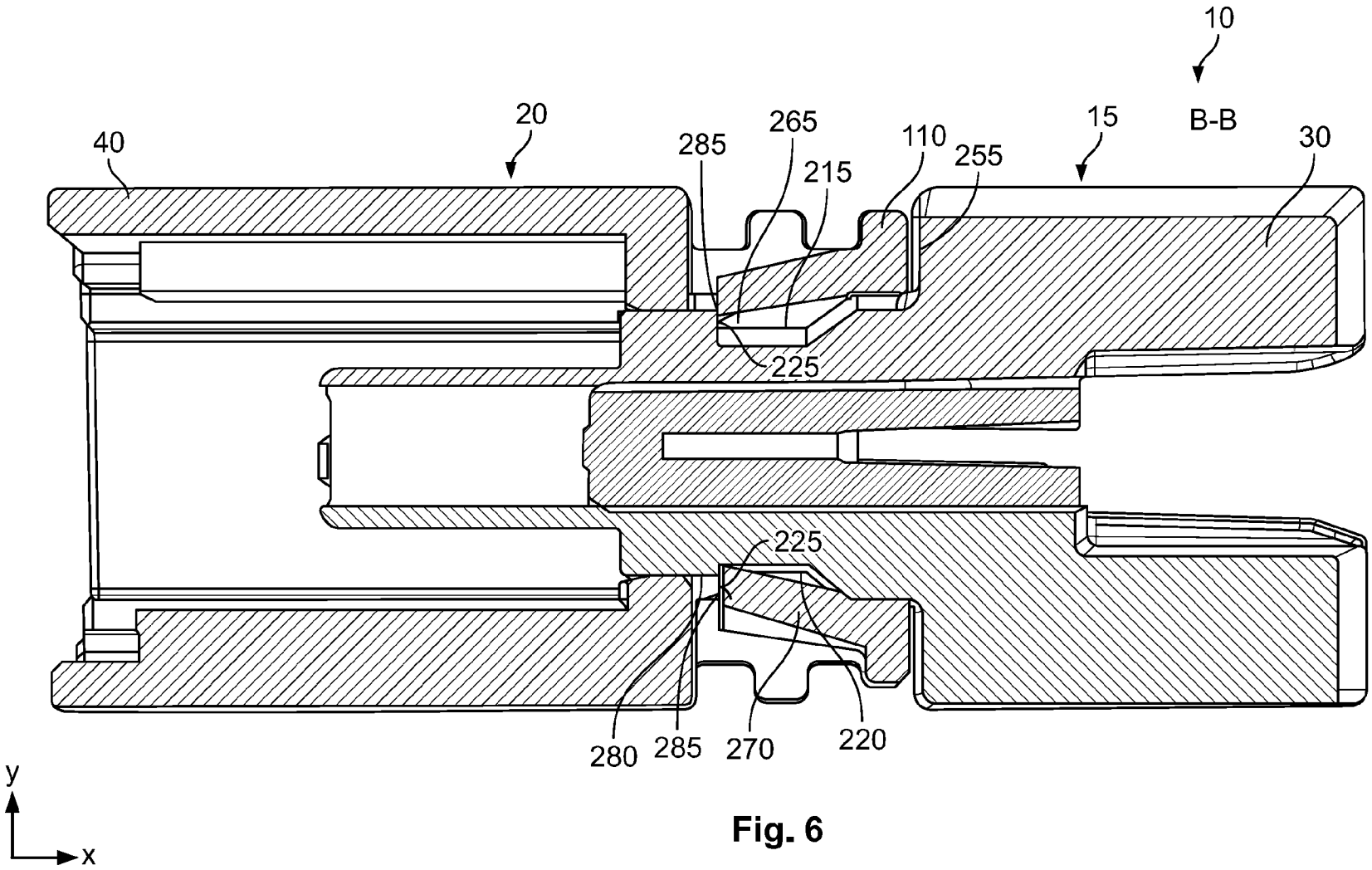
FIG. 6 is a sectional side view of the contact system in an assembled state, taken along plane B-B of FIG. 1.

FIG. 6 shows a sectional view along the section plane B-B, shown in FIG. 1, through the contact system 10 in the preassembled state. In the premounted state of the first contact device 15, the first contact device 15 is pushed into the second contact device 20. In this case, the first detent spring 265 engages in the first latching receptacle 215 and the second detent spring 270 engages in the second latching receptacle 220. In this case, at the second free end 280, the latching surface 285 of the respective detent spring 265, 270 lies against the stop surface 225 and connects the first contact housing 30 to the second contact housing 40 in a form-fitting manner. Furthermore, the first end face 110 comes to a stop on the second end face 255, or the further pushing-in of the first encoding unit 95 into the first receptacle 130 is prevented by the resting of the opening 250 on the rounded portion 176. As a result, the position of the second contact housing 40 in relation to the first contact housing 30 in the longitudinal direction is set.

The latching device 260 ensures that the first shaft section 145 is plugged completely into the first receptacle 130 without tilting and engages completely through the first receptacle 130. Furthermore, the latching device 260 secures the second contact housing 40 on the first contact housing 30 in the preassembled state of the contact system 10, thus when the first head section 150 is not yet shaped. The securing and an undesired pulling-away of the first contact housing 30 from the second contact housing 40 is prevented by an abutment of the latching surface 285 against the stop surface 225.

Figure 7:
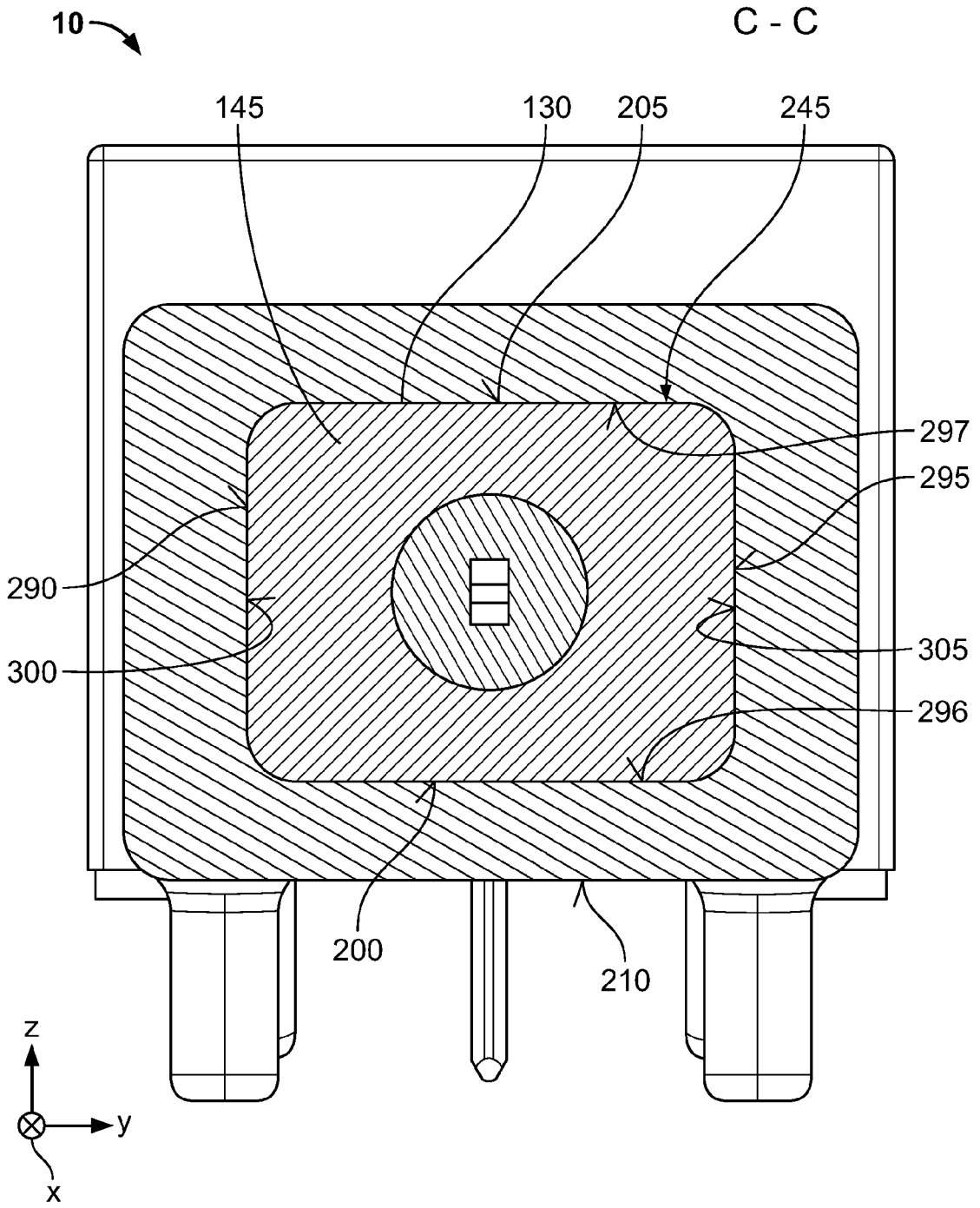
FIG. 7 is a sectional end view of the contact system, taken along plane C-C of FIG. 1.

FIG. 7 shows a sectional view along a section plane C-C, shown in FIG. 1, through the contact system 10. The third section 245 has, on the inside, a first inner surface section 296, a second inner surface section 297, a third inner surface section 300, and a fourth inner surface section 305. The first inner surface section 296 is arranged on a side facing the underside 210 and is aligned parallel to the underside 210. The second inner surface section 297 is arranged opposite in the z-direction on the outside. The third inner surface section 300 and the fourth inner surface section 305 are arranged laterally. The third inner surface section 300 is arranged opposite the fourth inner surface section 305. The third inner surface section 300 and the fourth inner surface section 305 each extend parallel to the z-axis and connect the first inner surface section 296 to the second inner surface section 297.

A further rounded portion can be provided between the inner surface sections 296, 297, 300, 305. The inner surface sections 296, 297, 300, 305 are each configured and aligned corresponding to the associated guide surface 200, 205, 290, 295. In the preassembled state, as well as in the finally assembled state, the first guide surface 200 lies against the first inner surface section 296, the second guide surface 205 lies against the second inner surface section 297, the third guide surface 290 lies against the third inner surface section 300 and the fourth guide surface 295 lies against the fourth inner surface section 305.

By way of the respective corresponding arrangement of the guide surface 200, 205, 290, 295, in relation to the inner surface sections 296, 297, 300, 305, when the first contact housing 30 is introduced into the second contact housing 40, the first shaft section 145 is centered in the first receptacle 130 in the third section 245 and a positioning and alignment of the first contact housing 30 and of the first coaxial contact unit 45 are set in relation to the second contact device 20 in the space. Furthermore, an incorrect alignment (for example when the first contact housing 30 is aligned twisted around the x-axis with respect to the second contact housing 40) of the first contact housing 30 with respect to the second contact housing 40 is prevented by way of the engagement of the first encoding unit 95 in the first receptacle 30. Furthermore, the first encoding unit 95, by way of the circumferential form-fitting connection with the first receptacle 130, prevents any one other than the second contact housing 40 from being plugged onto the first contact housing 30.

Figure 8:
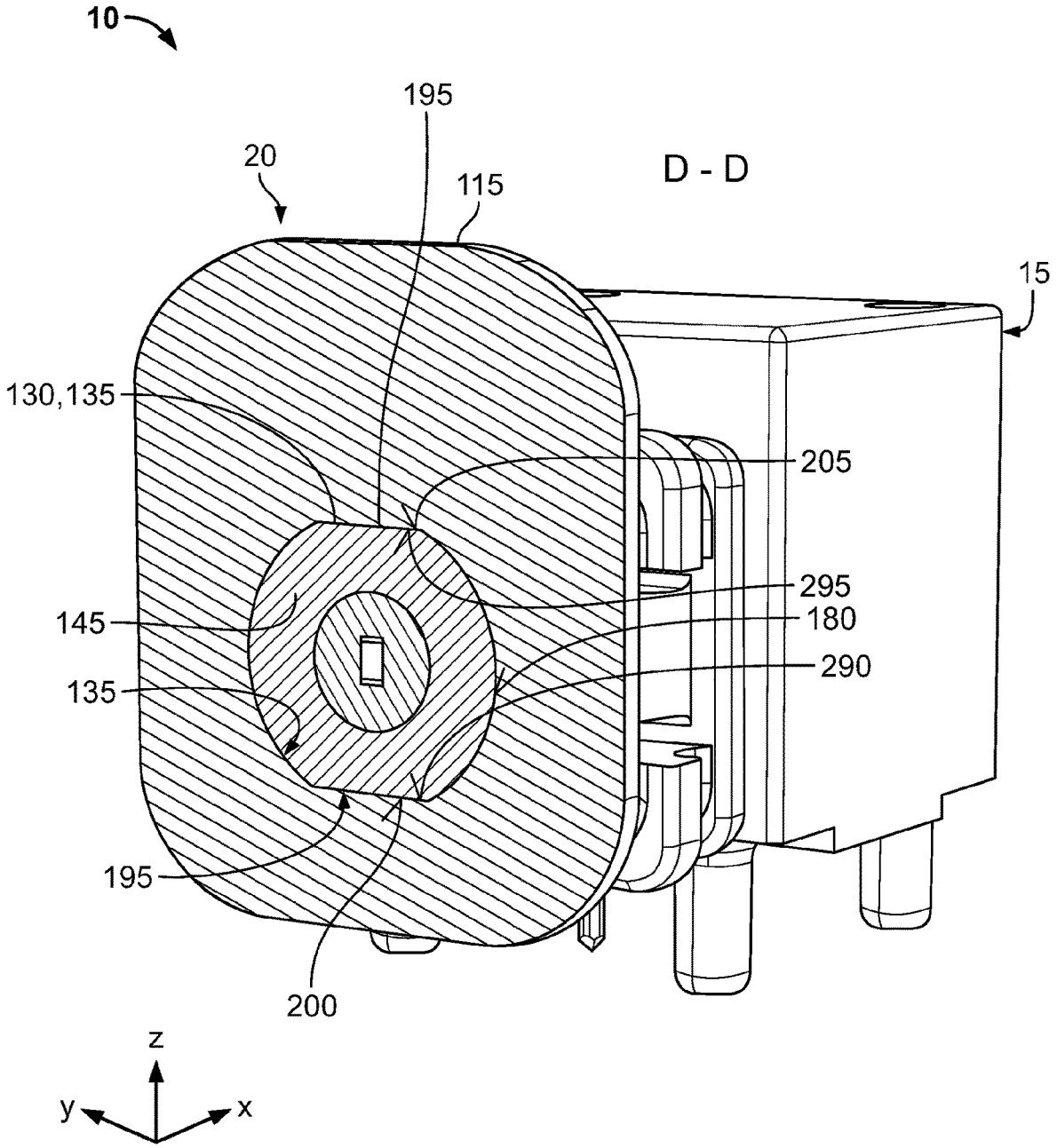
FIG. 8 is a sectional perspective view of the contact system, taken along plane D-D of FIG. 1.

FIG. 8 shows a sectional view along a section plane D-D, shown in FIG. 1, through the contact system 10 shown in FIG. 1. The first guide surface 200 and the second guide surface 205 extend in the longitudinal direction (x-direction) over the entire maximum longitudinal extent of the first shaft section 145, such that the first and second guide surfaces 200, 205 are arranged on the upper side and lower side of the second region 195 of the first shaft section 145 as well. The second region 195, however, does not have the third and fourth guide surfaces 290, 295. The second region 195 has a circular configuration of the second outer circumferential side 180 between the first and the second guide surfaces 200, 205. Likewise, the first inner surface section 296 and the second inner surface section 297 are lengthened further into the first section 135 of the first receptacle 130, and, between the first inner surface section 296 and the second inner surface section 297, the first receptacle 130 in the first section 135 is configured in a rounded manner corresponding to the configuration of the second region 195.

Figure 9:
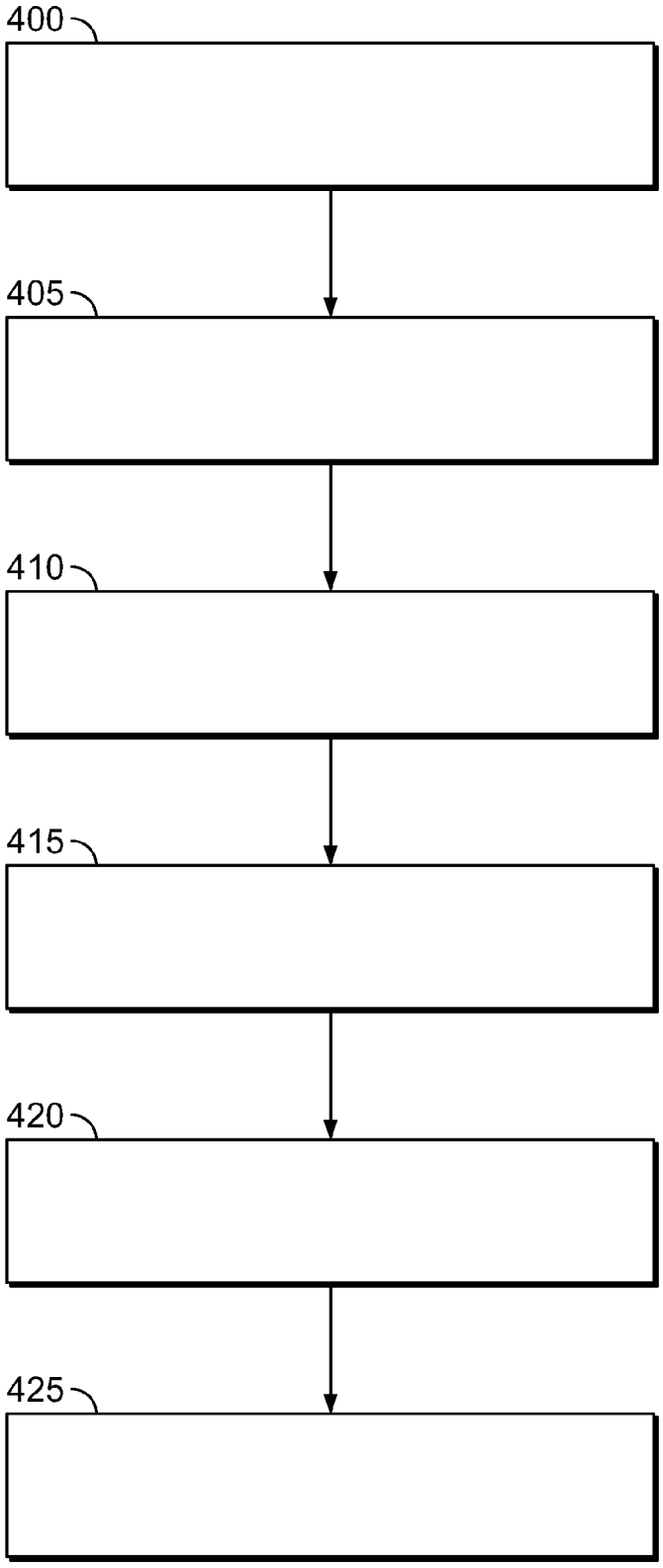
FIG. 9 is a flowchart of a method for producing the contact system.

In a first method step 400, shown in FIG. 9, the first contact device 15 and the second contact device 20 are produced separately in a separate production method and provided at the end of the first method step 400. In this case, for example, the first contact housing 30 can be produced by an injection molding method.

In a second method step 405, shown in FIG. 9, the first shaft section 145 is inserted into the first receptacle 130. In this case, the guide surfaces 200, 205, 290, 295 orientate and/or guide and/or position the first contact housing 30 in the second contact housing 40 by lying against the inner surface sections 295, 297, 300, 305. Furthermore, as a result, the first coaxial contact unit 45 is aligned in a defined manner in relation to the second coaxial contact unit 50, such that the first and second coaxial contact units 45, 50 can be pushed into one another without becoming jammed, and thus a reliable electrical contact can be ensured between the first and second coaxial contact units 45, 50.

When the first shaft section 145 is inserted into the first receptacle 130, the first region 190 of the first shaft section 145 presses the detent springs 265, 270 in a resilient manner outwards and pivots them into an unlocked position, such that the first shaft section 145 can be pushed into the first receptacle 130 until it enters a final position. In this case, the detent springs 265, 270 are stressed. If the final position of the first encoding unit 95 in the first receptacle 130 is reached, the detent springs 265, 270 snap out of the unlocked position into a locked position, the first detent spring 265 engaging in the first latching receptacle 215 and the second detent spring 270 engaging in the second latching receptacle 220 in the locked position, such that the first contact housing 30 is connected to the second contact housing 40 in a form-fitting manner.

Figure 10:
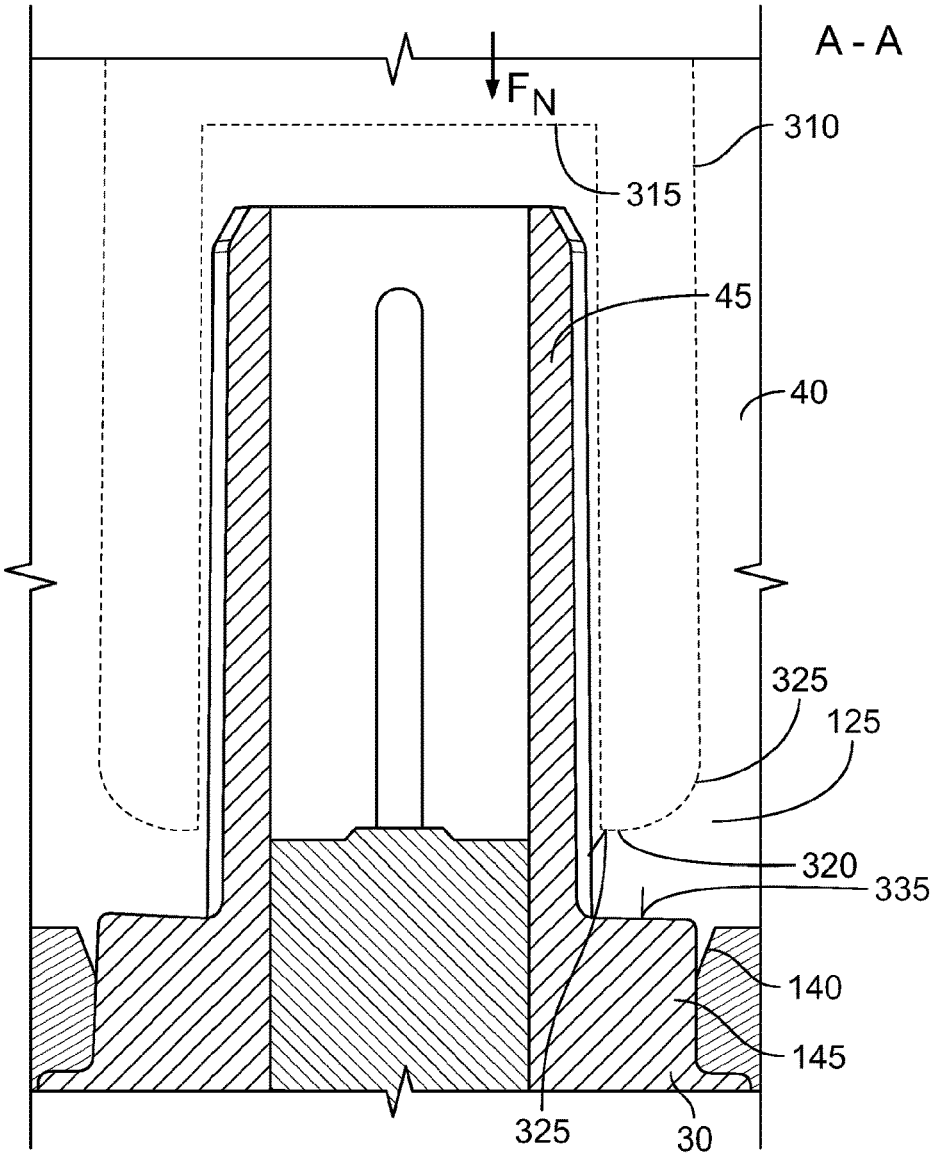
FIG. 10 is a sectional side view of the contact system in a third method step, taken along plane A-A of FIG. 1.

In the third method step 410, shown in FIGS. 9 and 10, a riveting tool 310, for riveting the first encoding unit 95, is inserted into the second contact receptacle 125 of the second contact housing 40 from a side facing away from the first contact housing 30. The riveting tool 310 has, on the inside, a third contact receptacle 315 for receiving the first coaxial contact unit 45. At the end face on a side facing the first shaft section 145, the riveting tool 310 has a defined stamping outline 320. The predefined stamping outline 320 is configured to shape a geometry of the first head section 150. The stamping outline 320 has a third end face 325, configured in a planar manner, which is adjoined radially outwards by a rounded-portion section 330. The third end face 325 is placed onto a fourth end face 335 of the first shaft section, which faces the riveting device 310.

Figure 11:
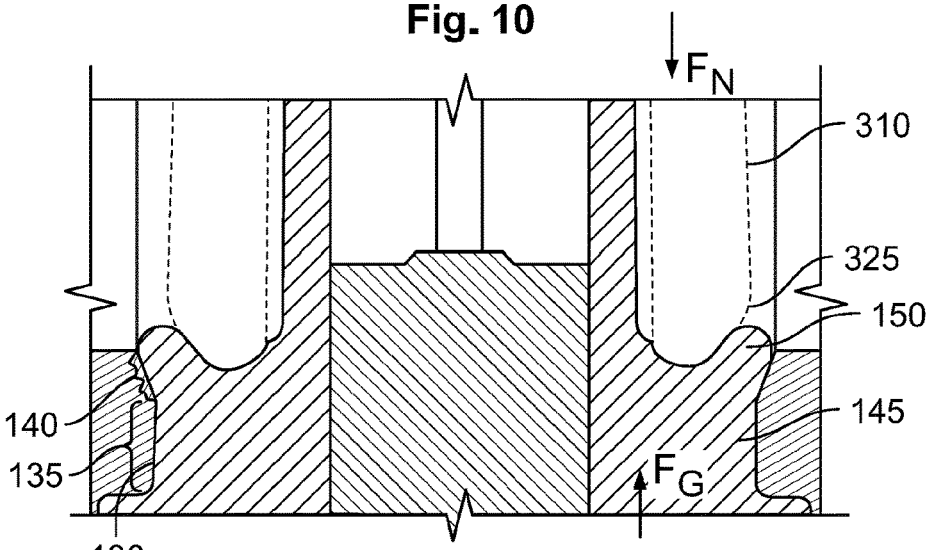
FIG. 11 is a is a sectional side view of the contact system in a fourth method step, taken along plane A-A of FIG. 1.

In a fourth method step 415, shown in FIGS. 9 and 11, a riveting force FN, for riveting the contact housing 30, 40, is applied onto the riveting tool 310, which force acts against the fourth end face 335. The contact system 10 is supported on the rear side at the first housing section 100 for providing a counterforce, FG which acts counter to the riveting force FN. By the riveting force FN and the counterforce FG, the stamping outline 320 is pressed onto the fourth end face 335 of the first shaft section 145. The riveting force FN is so great in this case that the substance of the first shaft section 145 flows outwards into the second section 140, and the first head section 150 is shaped from an end region of the first shaft section 145. The stamping outline 325 in this case defines the geometric configuration of the first head section 150 and the rear engagement of the first head section 150 in the second contact housing 40.

In a fifth method step 420 shown in FIG. 9, the riveting tool 310 is removed.

In a sixth method step 425 shown in FIG. 9, the second coaxial contact unit 50 is introduced into a second contact receptacle 125 and an electrical contact to the first coaxial contact unit 45 is formed.

Figure 12:
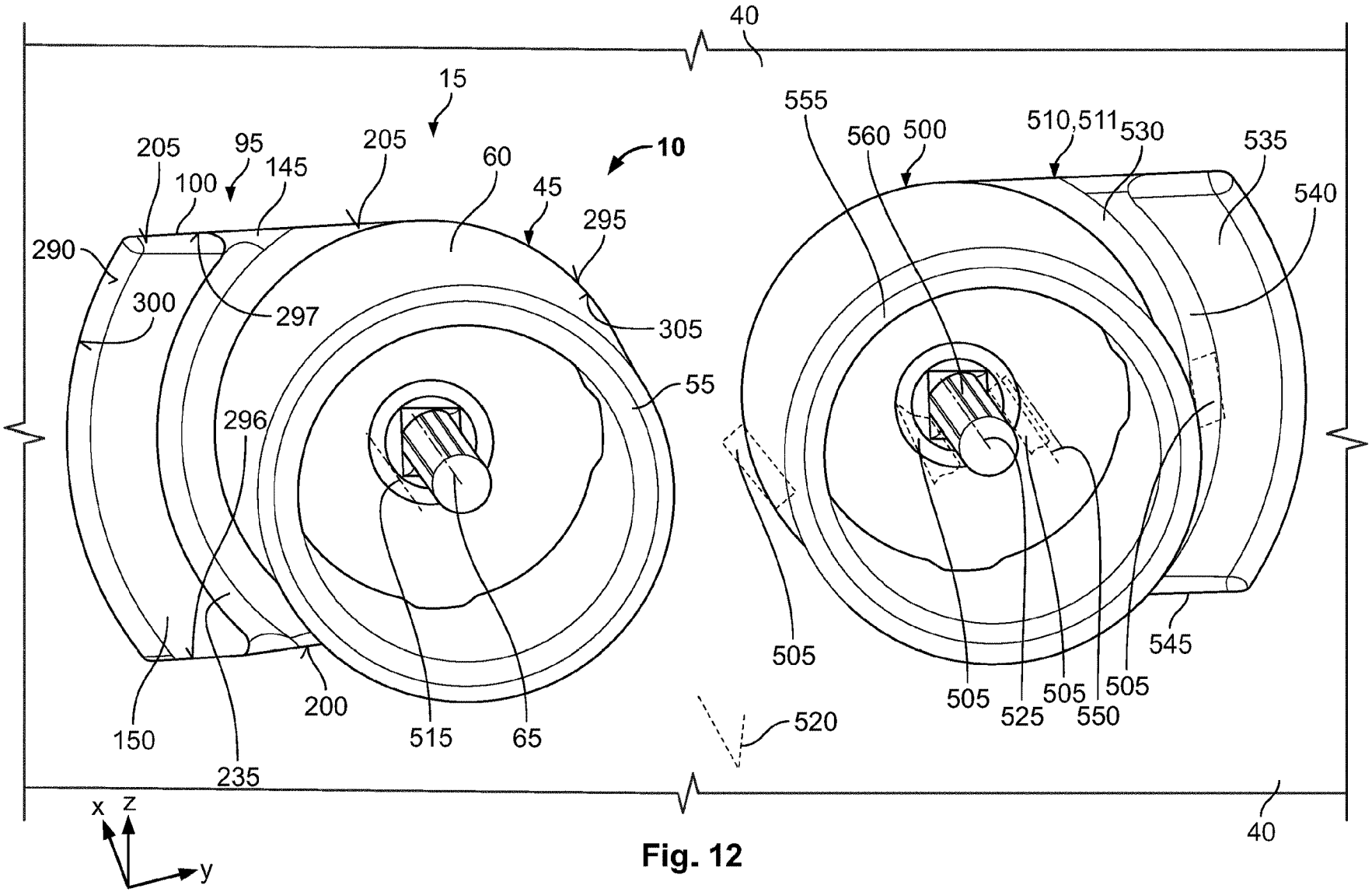
FIG. 12 is a perspective view of a contact system according to another embodiment.

A contact system 10 according to another embodiment is shown in FIG. 12. The contact system 10 is configured substantially identically to the contact system 10 shown in FIG. 1. Hereinafter, only the differences of the contact system 10 shown in FIG. 12 compared to the contact system 10 shown in FIGS. 1 to 11 will be discussed.

The first contact device 15 has, in addition to the first coaxial contact unit 45, a third coaxial contact unit 500 as shown in FIG. 12. The third coaxial contact unit 500 is configured substantially identically to the first coaxial contact unit 45. In the y-direction, the third coaxial contact unit 500 is arranged laterally offset in relation to the first coaxial contact unit 45, in a common xy-plane with the first coaxial contact unit 45. The third coaxial contact unit 500 is configured, in the mounted state of the first contact device 15 on the second contact device 20, to form an electrical contact to a fourth coaxial contact unit 505 of the second contact device 20. The fourth coaxial contact unit 505 is indicated in dashed lines in FIG. 12 and is configured identically to the second coaxial contact unit 50, as well as laterally offset in the y-direction in relation to the second coaxial contact unit 50 in the second contact housing 40.

The first contact housing 30 has a second encoding unit 510 in addition to the first encoding unit 95, as shown in FIG. 12. The first encoding unit 95 and the second encoding unit 510 have substantially the configuration of the first encoding unit 95 explained in FIGS. 1 to 11. In contrast to the preceding figures, in FIG. 12 the first encoding unit 95 is not configured substantially rotationally symmetrically around the contact axis 65.

In the embodiment shown in FIG. 12, the first guide surface 200 and the second guide surface 205 are configured in a planar manner here, as shown in FIGS. 1 to 10. The third guide surface 290 and the fourth guide surface 295 are configured in a curved or arched manner. In this case, the third guide surface 290 runs on a circular path around a first rotation axis 515, which is arranged offset in the y-direction in relation to the contact axis 65 of the first coaxial contact unit 45 on a side facing away from the third coaxial contact unit 500.

The first receptacle 130 is configured in a manner corresponding to the first shaft section 145, such that the first receptacle 130 laterally likewise has arch-shaped third and fourth inner surface sections 300, 305, and first and second inner surface sections 296, 297 configured in a planar manner.

In the embodiment shown in FIG. 12, the third guide surface 290 is arranged offset outwards on a side facing away from the third coaxial contact unit 500. The fourth guide surface 295 is arranged in a manner running in an arch shape on a circular path around the contact axis 65. The first head section 150 is provided adjacent to the third guide surface 290. On the upper side and lower side, the first head section 150 is bordered by the first guide surface 200 and the second guide surface 205. The first recess 235 is likewise arranged running in an arch shape around the first rotation axis 515. The first recess 235 is arranged radially between the first outer contact 55 and the first head section 150. Furthermore, the second recess 240 explained in FIGS. 1 to 11 is dispensed with.

The second encoding unit 510 is configured mirror-symmetrically to the first encoding unit 95 with regard to a plane of symmetry 520, which is arranged in the middle between the contact axis 65 of the first coaxial contact unit 45 and a further contact axis 525 of the third coaxial contact unit 500. The further contact axis 525 runs in the middle of a third inner contact 526 of the third contact device 500 parallel to the x-axis. In the embodiment, the plane of symmetry 520 runs in an xz-plane by way of example.

The second encoding unit 510 has a second riveting device 511, as shown in FIG. 12. The second riveting device 511 has, in addition to a second shaft section 530, a second head section 535 and a third recess 540. The second shaft section 530 engages through a second recess 545 of the second contact housing 40. The second receptacle 545 is likewise arranged mirror-symmetrically to the first receptacle 130 with regard to the plane of symmetry 520.

The second shaft section 530 is configured as a hollow body, the third coaxial contact unit 500 being arranged on the inside of the second shaft section 530, as shown in FIG. 12. The second shaft section 530 and a third outer contact 555 of the third coaxial contact unit 500 can be configured in an integral and materially uniform manner. Furthermore, in order to form a further rivet, the second shaft section 530 and the second head section 535 are configured in an integral and materially uniform manner. The second shaft section 530 is connected by a further solid end (hidden by the second contact housing 40 in FIG. 12) to the first end face 110 of the first contact housing 30 and protrudes over the first end face 110 of the first contact housing 30. At a further free end (in the x-direction) of the second shaft section 530, the second head section 535 is arranged at the second shaft section 530.

The second head section 535 is arranged on the inside on a side facing away from the first coaxial contact unit 45. The second head section 535 engages behind the second contact housing 40 on the inside. In this case, the second head section 535 runs on a further circular path around a second rotation axis 550. The second rotation axis 550, the further contact axis 525, the contact axis 65 and the first rotation axis 515 are arranged together in a common xy-plane and run parallel and parallel to one another and to the x-axis. The second rotation axis 550 is arranged on a side facing away from the first coaxial contact unit 45, offset in relation to the further contact axis 525. The further contact axis 525 runs in the middle along a third inner contact 560 of the third coaxial contact unit 500.

The third recess 540 likewise runs in a circular manner around the second rotation axis 550, as shown in FIG. 12. Through the arrangement of the first head section 150 and of the second head section 535 on mutually opposing sides of the first coaxial contact unit 45 and of the third coaxial contact unit 500 in each case, a spacing between the two head sections 150, 535 can be maximized, so that the head sections 150, 535 can, in particular, support torques around the z-axis particularly well. Furthermore, the first and third coaxial contact units 45, 500 can be secured close to one another particularly in the y-direction. Furthermore, no additional installation space is necessary in the vertical direction (z-direction), since in the embodiment the first guide surface 200 and the second guide surface 205 are arranged tangentially to an outer circumferential surface of the first outer contact 60 of the first coaxial contact unit 45 and of the third coaxial contact unit 500.

Alternatively, it would also be conceivable for the first head section 150 and/or the second head section 535 to be arranged in the y-direction between the first coaxial contact unit 45 and the third coaxial contact unit 500. It would also be conceivable to dispense with one of the two encoding units 95, 510. The first encoding unit 95, shown in FIG. 1, could also be provided at the first coaxial contact unit 45 and/or third coaxial contact unit 500.

Furthermore, it should be noted that a different configuration of the contact system 10 is conceivable. In particular, both a number of coaxial contact units 45, 50, 500, 505 and/or encoding units 95, 510 are conceivable. The number of encoding units 95, 510 can also be smaller or greater than the number of the first and third coaxial contact units 45, 500.

The embodiment of the contact system 10 shown in FIG. 12 can be produced by the method explained in FIG. 9. In this case, the riveting tool 310 can shape the head sections 150, 535 sequentially or can, in an embodiment, shape the head sections 150, 535 simultaneously in the case of a corresponding geometric configuration of the riveting tool 310, so that tilting of the contact housing 30, 40 can be avoided during the riveting.

What is claimed is:

1. A contact device for a contact system, comprising:

a first coaxial contact unit having a first inner contact and a first outer contact arranged circumferentially in relation to the first inner contact, the first outer contact is arranged spaced apart from the first inner contact and coaxially with regard to a contact axis of the first inner contact, the first coaxial contact unit forms an electrical contact to a second coaxial contact unit of a further contact device of the contact system; and a first contact housing connected to the first coaxial contact unit, the first contact housing has a first encoding unit arranged adjacent to the first outer contact, the first encoding unit has a first expandable rivet arranged therewithin with a first head section and a first shaft section connected to the first head section, the first shaft section arranged radially outward from and receiving the first outer contact therewithin, the first shaft section engages a first section of a first receptacle of a second contact housing of the further contact device and positions the first contact housing relative to the second contact housing, the first head section protrudes laterally with a first outer circumferential side over a second outer circumferential side of the first shaft section.

2. The contact device of claim 1, wherein the first shaft section is a hollow body discrete from the first outer contact, the first head section is arranged at a first free end of the first shaft section, and the first shaft section and the first head section are configured in an integral and materially uniform manner.

3. The contact device of claim 2, wherein the first shaft section is connected by a first solid end to an end face of the first contact housing and protrudes over the end face.

4. The contact device of claim 1, wherein the first shaft section has a first guide surface at the second outer circumferential side, the first guide surface is aligned substantially parallel to the contact axis.

5. The contact device of claim 4, wherein the first guide surface guides the first contact housing laterally during a plugging-in movement into the second contact housing and/or sets an orientation of the first contact housing relative to the second contact housing in a defined manner.

6. The contact device of claim 5, wherein the first shaft section has a second guide surface at the second outer circumferential side, the second guide surface and the first guide surface are each planar and are aligned parallel to one another.

7. The contact device of claim 5, wherein first encoding unit has a recess at least in the first head section and/or in the first shaft section, the recess is open on a side facing away from an end face of the first contact housing.

8. The contact device of claim 7, wherein the recess is formed in a groove-like manner and/or is guided on a circular path around the contact axis and/or runs parallel to the contact axis.

9. The contact device of claim 1, further comprising a third coaxial contact unit arranged laterally offset in relation to the first coaxial contact unit, the third coaxial contact unit is identical to the first coaxial contact unit.

10. The contact device of claim 9, wherein the first contact housing and the third coaxial contact unit are connected to one another and the third coaxial contact unit forms an electrical contact to a fourth coaxial contact unit of the further contact device.

11. The contact device of claim 10, wherein the first contact housing has a second encoding unit, the second encoding unit is laterally offset in relation to the first coaxial contact unit, the second encoding unit is adjacent to the third coaxial contact unit and has a second rivet.

12. The contact device of claim 11, wherein the second encoding unit engages in a second receptacle of the second contact housing and sets a positioning of the first contact housing relative to the second contact housing, the second rivet has a second head section and a second shaft section connected to the second head section, the second shaft section engages through the second receptacle and the second head section engages behind the second contact housing at the second receptacle.

13. The contact device of claim 12, wherein the second shaft section is a hollow body, the third coaxial contact unit is arranged on an inside of the second shaft section, and the second shaft section and the second head section are configured in an integral and materially uniform manner.

14. The contact device of claim 13, wherein the second shaft section is connected by a further solid end to an end face of the first contact housing and protrudes over the end face, the second head section is arranged at a further free end of the second shaft section.

15. The contact device of claim 14, wherein the first head section is arranged on a side facing away from the third coaxial contact unit and the second head section is arranged on a side facing away from the first coaxial contact unit.

16. A contact system, comprising:

a first contact device including:

a first coaxial contact unit having a first inner contact and a first outer contact arranged circumferentially in relation to the first inner contact, the first outer contact is arranged spaced apart from the first inner contact and coaxially with regard to a contact axis of the first inner contact; and a first contact housing connected to the first coaxial contact unit, the first contact housing has a first encoding unit arranged adjacent to the first outer contact, the first encoding unit has a first expandable rivet with a first head section and a first shaft section connected to the first head section, the first head section protrudes laterally with a first outer circumferential side over a second outer circumferential side of the first shaft section; and a second contact device including a second contact housing and a second coaxial contact unit, the first coaxial contact unit engages and electrically connects with the second coaxial contact unit, the first shaft section engages through a first receptacle of the second contact housing and sets a position of the first contact housing relative to the second contact housing, in an expanded state the first head section engages behind the second contact housing at the first receptacle and opposes the second housing in a removal direction independent of the relative angular positions of the first contact housing and the second contact housing about a mating axis.

17. The contact system of claim 16, wherein the first receptacle has a first section and a second section, the first section is arranged on a side facing the first contact housing, the second section adjoins a side facing away from the first contact housing, the second section is widened with respect to the first section, the first head section engages in the second section.

18. A method for assembling a contact system, comprising:

providing a first contact device including:

a first coaxial contact unit having a first inner contact and a first outer contact arranged circumferentially in relation to the first inner contact, the first outer contact is arranged spaced apart from the first inner contact and coaxially with regard to a contact axis of the first inner contact; and a first contact housing connected to the first coaxial contact unit, the first contact housing has a first encoding unit arranged adjacent to the first outer contact, the first encoding unit has a first riveting device with a first head section and a first shaft section connected to the first head section, the first head section protrudes laterally with a first outer circumferential side over a second outer circumferential side of the first shaft section;

providing a second contact device including a second contact housing and a second coaxial contact unit, the second contact housing having a first receptacle;

inserting the first encoding unit into the first receptacle until it enters a final position in which the first shaft section engages the first receptacle;

placing a riveting tool onto an end face of the first shaft section; and introducing a riveting force into the first shaft section with the riveting tool, the riveting tool shapes the first head section at the first shaft section in such a way that the first head section engages behind the second contact housing at the first receptacle.

19. The contact device of claim 1, wherein, in an expanded state, the rivet secures the first contact housing to the second contact housing independent of the relative angular positions of the first contact housing and the second contact housing about a mating axis.

20. The contact device of claim 1, wherein the rivet surrounds the first outer contact in the radial direction.

* * * * *